US008702875B2

(12) United States Patent
Kim et al.

(10) Patent No.: US 8,702,875 B2
(45) Date of Patent: Apr. 22, 2014

(54) HIGH STRENGTH STEEL SHEET WITH GOOD WETTABILITY AND MANUFACTURING METHOD THEREOF

(75) Inventors: Hoon-Dong Kim, Gyeonggi-Do (KR); Hyun-Ho Bok, Chungcheongnam-Do (KR); Kang-Roh Lee, Chungcheongnam-Do (KR); Man-Been Moon, Gyeonggi-Do (KR)

(73) Assignee: Hyundai Steel Company, Incheon (KR)

( * ) Notice: Subject to any disclaimer, the term of this patent is extended or adjusted under 35 U.S.C. 154(b) by 269 days.

(21) Appl. No.: 12/761,994

(22) Filed: Apr. 16, 2010

(65) Prior Publication Data

US 2011/0209800 A1 Sep. 1, 2011

(30) Foreign Application Priority Data

Feb. 26, 2010 (KR) ..... 10-2010-0017976

(51) Int. Cl.

| | |
|---|---|
| ***C22C 38/22*** | (2006.01) |
| ***C22C 38/24*** | (2006.01) |
| ***C22C 38/12*** | (2006.01) |
| ***C21D 8/02*** | (2006.01) |
| ***C23C 2/28*** | (2006.01) |

(52) U.S. Cl.
USPC ..... 148/334; 148/320; 148/533; 148/603; 148/651; 148/652

(58) Field of Classification Search
CPC ..... C22C 38/24; C22C 38/22; C21D 8/0226; C21D 2211/005; C21D 2211/008; C23C 2/28
USPC ..... 148/320, 333, 334, 533, 603, 651, 652; 428/659
See application file for complete search history.

(56) References Cited

U.S. PATENT DOCUMENTS

| | | | | |
|---|---|---|---|---|
| 6,312,536 | B1 * | 11/2001 | Omiya et al. | 148/533 |
| 6,410,163 | B1 * | 6/2002 | Suzuki et al. | 428/659 |
| 6,440,584 | B1 * | 8/2002 | Nagataki et al. | 428/659 |

FOREIGN PATENT DOCUMENTS

| | | |
|---|---|---|
| JP | 2005298877 | 10/2005 |
| JP | 2005320619 | 11/2005 |
| JP | 2007-302918 | 11/2007 |
| JP | 2008174766 | 7/2008 |
| JP | 2008208406 | 9/2008 |

* cited by examiner

*Primary Examiner* — Deborah Yee

(74) *Attorney, Agent, or Firm* — Lowe Hauptman & Ham, LLP

(57) ABSTRACT

The present disclosure relates to a high strength steel sheet having good wettability, a tensile strength of 590 MPa or more and a strength-ductility balance (TS×El) of 16,520 MPa·% or more, and a manufacturing method thereof. The high strength steel comprises, in % by weight, C: 0.03~0.1%, Si: 0.005~0.105%, Mn: 1.0~3.0%, P: 0.005~0.04%, S: 0.003% or less, N: 0.003~0.008%, Al: 0.05~0.4%, Mo or Cr satisfying the inequality $10 \leq 50 \cdot [Mo\ \%] + 100 \cdot [Cr\ \%] \leq 30$, at least one of Ti: 0.005~0.020%, V: 0.005~0.050% and B: 0.0005~0.0015%, and the balance of Fe and unavoidable impurities, wherein a microstructure of the steel sheet is a multi-phase structure comprising, in an area ratio of cross-sectional structure, 70% or more ferrite phase having a Vickers hardness Hv of 120~250 and 10% or more martensite phase having a Vickers hardness Hv of 321~555.

9 Claims, 3 Drawing Sheets

HIGH STRENGTH STEEL SHEET WITH GOOD WETTABILITY AND MANUFACTURING METHOD THEREOF

BACKGROUND OF THE INVENTION

1. Field of the Invention

The present invention relates to a technique for manufacturing high strength cold-rolled steel sheets or hot-dip galvanized steel sheets primarily used for automotive panels or structural components, and, more particularly, to cold-rolled steel sheets and hot-dip galvanized steel sheets having good wettability while guaranteeing mechanical properties including a tensile strength of 590 MPa or more and a strength-ductility balance (TS×El) of 16,520 MPa·% or more, and a manufacturing method thereof.

2. Description of the Related Art

In recent years, automobile manufacturers have made various attempts to increase strength of a vehicle body and enhance fuel efficiency in order to satisfy provisions relating to increasingly strengthened safety and environmental regulations. Automobile manufacturers have made efforts towards development of automobiles that are environmentally friendly while having high strength and reduced weight.

Further, with complicated designs of automobiles and diversification of consumer demand, the automobile manufacturers also require steels that have high strength with good workability and formability.

Since strengthening steel sheets for automobiles leads to deterioration in formability, however, it is difficult to satisfy both strength and formability at the same time. In addition, impurities added for strengthening the steel sheets make it more difficult to manufacture a plated steel sheet with a pleasant surface.

For automotive interior panels, it has been attempted to achieve high strength by enhancing formability of the existing phosphorous (P)-added high strength steel, but desired strength is still not obtained due to a strength reduction resulting from insufficient formability and thickness reduction. For the automobile manufacturers, however, since it is possible to achieve cost reduction through reduction of the number of processes by application of high strength steel with good formability, the development of high formability and high strength steel has been consistently required.

For automotive exterior panels, soft cold-rolled steel sheets, for example, extremely low-carbon IF (interstitial-free) steel, and 340 MPa-grade high formability and high strength steel are primarily applied, and higher strength steel sheets are applied to some automotive components, which require higher strength.

In order to enhance strength and formability of such a steel sheet for automobiles, solid solution strengthening elements, such as silicon (Si), manganese (Mn), phosphorous (P), and the like, are generally added to improve strength of the steel sheet, and carbon nitride formation elements, such as titanium (Ti), niobium (Nb), and the like, are generally added to enhance formability. For example, multi-phase high strength steel sheets have been developed.

The multi-phase high strength steel sheet has a combined soft ferrite structure and hard martensite structure and demonstrates low yield strength and high strength-ductility balance.

However, silicon (Si), manganese (Mn), and the like added for strength enhancement cause concentration of silicon-based oxides on the surface of the steel sheet during annealing after cold rolling, so that surface characteristics of the plated steel sheet are deteriorated, thereby making it difficult to manufacture galvanized steel sheets with pleasant surfaces for automotive applications.

As hot-dip galvanized high strength steel sheets with good formability, a steel sheet has been suggested, which comprises, in % by weight (hereinafter, wt %), C: 0.12~0.70%, Si: 0.4~4.8%, Mn: 0.2~2.5%, Al: 0.01~0.07%, N: 0.02% or less, and the balance of Fe and unavoidable impurities. This steel sheet is based on so-called Transformation Induced Plasticity (TRIP), and has a combined structure of ferrite, bainite and residual austenite.

As compared with a steel sheet having a multi-phase of ferrite and martensite and the same strength, this steel sheet has a much higher Si content of 0.4 wt % or more, which leads to deterioration in paintability and wettability, thereby making it difficult to produce galvanized steel sheets with pleasant surfaces.

Therefore, a long-term pickling process is required to guarantee desired paintability and wettability with TRIP steel sheets, thereby causing an increase of manufacturing costs.

In recent years, as a steel sheet capable of satisfying both good formability and high strength after formation, a bake hardening (BH) steel sheet has been developed, which is soft before pressing to allow easy pressing and is hardened by paint phosphating after pressing, thereby providing high strength to components.

One example of the BH steel sheet includes a high strength cold-rolled steel sheet, which comprises, in % by weight, C: 0.05~0.30%, Si: 0.4~2.0%, Mn: 0.7~3.0%, Al: 0.02% or less, N: 0.0050~0.0250% and dissolved N: 0.0010%, has a combined structure of ferrite, bainite and residual austenite, and exhibits good age hardening properties.

However, this steel sheet also has an Si content of 0.4 wt % or more in order to stabilize the residual austenite, which leads to deterioration in paintability and wettability, thereby making it difficult to produce galvanized steel sheets with pleasant surfaces.

In other words, conventionally, a large amount of Si greater than or equal to 0.4 wt % is added to the steel sheet in order to form the combined structure consisting of the ferrite, bainite and residual austenite while significantly enhancing tensile strength and strength-ductility balance. This is because carbon required for generation and stabilization of the residual austenite can be effectively concentrated in austenite during annealing by addition of a great amount of Si which serves to suppress formation of $Fe_3C$.

The steel sheet containing Si in an amount of 0.4 wt % or more has enhanced tensile strength and strength-ductility balance, but suffers from concentration of silicon-based oxides on the surface thereof, which leads to deterioration of paintability and wettability, thereby making it difficult to produce galvanized steel sheets with pleasant surfaces.

SUMMARY OF THE INVENTION

The present invention is directed to solving the problems as described above, and an aspect of the present invention is to provide a high strength steel sheet that has a relatively low Si content to have good wettability while guaranteeing good mechanical properties including a tensile strength of 590 MPa or more and a strength-ductility balance (TS×El) of 16,520 MPa·% or more.

Another aspect of the present invention is to provide a method of manufacturing a high strength steel sheet, which has good wettability while guaranteeing good mechanical properties including a tensile strength of 590 MPa or more and a strength-ductility balance (TS×El) of 16,520 MPa·% or more through an alloy composition and cooling conditions.

In accordance with an aspect of the present invention, there is provided a high strength steel sheet with good wettability, which comprises, in % by weight, C: 0.03~0.1%, Si: 0.005~0.105%, Mn: 1.0~3.0%, P: 0.005~0.04%, S: 0.003% or less, N: 0.003~0.008%, Al: 0.05~0.4%, Mo or Cr satisfying the inequality 10≤50·[Mo %]+100·[Cr %]≤30, at least one of Ti: 0.005~0.020%, V: 0.005~0.050% and B: 0.0005~0.0015%, and the balance of Fe and unavoidable impurities, wherein a microstructure of the steel sheet is a multi-phase structure comprising, in an area ratio of cross-sectional structure, 70% or more ferrite phase having a Vickers hardness Hv of 120~250 and 10% or more martensite phase having a Vickers hardness Hv of 321~555.

In accordance with another aspect of the present invention, there is provided a method of manufacturing a high strength steel sheet with good wettability, comprising: reheating a steel slab to 1150~1250° C., the steel slab comprising, in % by weight, C: 0.03~0.1%, Si: 0.005~0.105%, Mn: 1.0~3.0%, P: 0.005~0.040%, S: 0.003% or less, N: 0.003~0.008%, Al: 0.05~0.4%, Mo or Cr satisfying the inequality 10·50·[Mo %]+100·[Cr %]≤30, at least one of Ti: 0.005~0.020%, V: 0.005~0.050% and B: 0.0005~0.0015%, and the balance of Fe and unavoidable impurities; hot rolling the reheated steel slab at a finish rolling temperature of $Ar_3$~$Ar_3$+70° C. to form a hot-rolled steel sheet; coiling the hot-rolled steel sheet at 550~650° C.; pickling the hot-rolled steel sheet; cold rolling the pickled steel sheet at a reduction ratio of 50~80%; annealing the cold-rolled steel sheet at a temperature of $Ar_1$~$Ar_3$; and cooling the annealed steel sheet to 400~600° C. at a cooling rate of 5~30° C./sec.

BRIEF DESCRIPTION OF THE DRAWINGS

The above and other aspects, features and advantages of the invention will become apparent from the detailed description in conjunction with the accompanying drawings, in which.

DETAILED DESCRIPTION OF THE EMBODIMENTS

Figure 1:
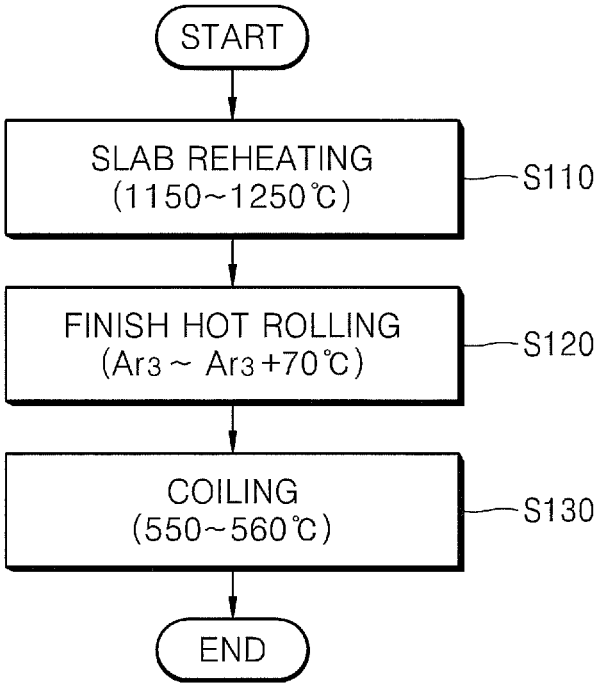
FIG. 1 is a flowchart of a method of manufacturing a high strength steel sheet in accordance with one embodiment of the present invention, showing a process of manufacturing a hot-rolled steel sheet from a steel slab.

The above and other aspects and features of the invention will become apparent from the following embodiments. However, it should be understood that the present invention is not limited to the following embodiments and may be embodied in different ways, and that the embodiments are given to provide complete disclosure of the invention and to provide thorough understanding of the invention to those skilled in the art. The scope of the invention is limited only by the accompanying claims and equivalents thereof. Like elements are denoted by like reference numerals throughout the specification.

Exemplary embodiments of the invention will now be described with reference to accompanying drawings.

According to one embodiment of the invention, a high strength steel sheet with good wettability comprises, in % by weight, C: 0.03~0.1%, Si: 0.005~0.105%, Mn: 1.0~3.0%, P: 0.005~0.04%, S: 0.003% or less, N: 0.003~0.008%, Al: 0.05~0.4%, Mo or Cr satisfying the inequality 10≤50·[Mo %]+100·[Cr %]≤30, at least one of Ti: 0.005~0.02%, V: 0.005~0.05% and B: 0.0005~0.0015%, and the balance of Fe and unavoidable impurities. Here, the unavoidable impurities are elements unavoidably contained in the steel sheet due to circumstances such as raw materials, manufacturing facilities, etc.

Next, components of the high strength steel sheet with good wettability according to the invention will be described in detail.

Carbon (C)

Carbon is an element added to secure strength of a steel sheet. Further, carbon serves to stabilize austenite depending on the amount of carbon concentrated in austenite.

In the steel sheet, the content of carbon may be in the range of 0.03~0.1 wt % with respect to a total weight of the steel sheet. The content of carbon may also be in the range of 0.05~0.08 wt % to secure extremely high strength-ductility balance and weldability.

Depending on the concentration of carbon in austenite, a degree of austenite stability is varied. When the content of carbon is less than 0.03 wt %, austenite is transformed into ferrite, making it difficult to obtain a desired phase fraction of martensite. Thus, in this invention, the steel sheet contains 0.03 wt % or more carbon. If the content of carbon exceeds 0.1 wt %, weldability is lowered and strength-ductility balance is deteriorated as the strength increases.

In this invention, the content of carbon (C) is set in a low carbon range of 0.03~0.1 wt % in order to guarantee anti-aging properties by securing the dissolved amount of carbon in the steel sheet. In this case, there are merits of eliminating a need for precise control of carbon (C) and nitrogen (N) contents.

Silicon (Si)

Si is an element which is used for strengthening a steel sheet without significantly lowering ductility of the steel sheet. Further, since silicon suppresses the formation of carbides during transformation of austenite into bainite and enhances stability of non-transformed austenite, it is desirable to add a suitable amount of silicon. Further, silicon minimizes a residual amount of inclusions in a welded part by improving flowability of molten metal during welding in suitable Mn-added steel.

In the steel sheet of this invention, the content of silicon may be in the range of 0.005~0.105 wt % with respect to a total weight of the steel sheet. If the content of silicon is less than 0.005 wt %, it is difficult to obtain the aforementioned effects of silicon, and if the content of silicon exceeds 0.105 wt %, silicon forms an $SiMn_2O_4$ phase on the surface of the steel sheet, thereby deteriorating wettability. This causes deterioration in surface quality of the steel sheet.

In this invention, the steel sheet contains 0.105 wt % or less silicon to enhance the wettability and paintability. Further, even in the case where the content of silicon is 0.105 wt % or less, high stability of non-transformed austenite can be maintained to thereby secure a suitable amount of residual austenite.

Manganese (Mn)

Manganese (Mn) is an effective element to prevent hot cracking, and thus, it is desirable to contain a suitable amount of Mn depending on the content of sulfur (S) in the steel. Further, manganese (Mn) is concentrated as a solid-solution strengthening element in austenite to stabilize residual austenite and greatly contributes to an increase in strength of the steel sheet by enhancing quenching properties.

In the steel sheet of this invention, the content of manganese (Mn) may be in the range of 1.0~3.0 wt % with respect to a total weight of the steel sheet. If the content of manganese is less than 1.0 wt %, the aforementioned effects of manganese are insignificant, and if the content of manganese exceeds 3.0 wt %, spot weldability is significantly deteriorated and Mn bands are developed at the thickness center of the material, thereby deteriorating bending properties. Thus, the content of Mn may be in the range of 1.0~3.0 wt %.

Phosphorus (P)

Phosphorus (P) is an element that enhances strength of a steel sheet through solid solution strengthening and is effective in suppressing carbide formation. Phosphorus (P) serves to prevent a reduction of elongation caused by the formation of carbides in an over-aging section. Further, phosphorus (P) is effective in securing a phase fraction of martensite through an increase in Mn equivalent.

In the steel sheet of this invention, the content of phosphorus (P) may be in the range of 0.005~0.04 wt % with respect to a total weight of the steel sheet. If the content of phosphorus (P) is less than 0.005 wt %, the aforementioned effects of phosphorus are insignificant, and if the content of phosphorus (P) exceeds 0.04 wt %, phosphorus forms a steadite structure of $Fe_3P$, causing hot embrittlement.

Sulfur (S)

Sulfur (S) deteriorates stiffness and weldability of a steel sheet and increases MnS non-metallic inclusions in the steel, thereby deteriorating the effect of Mn addition in dual phase steel. Further, when an excess of sulfur is added to steel, a great amount of coarse inclusions is produced in the steel, causing deterioration in fatigue characteristics. In this invention, since such problems occur when the content of sulfur in the steel sheet exceeds 0.003 wt %, the content of sulfur (S) is added in an amount of 0.003 wt % or less with respect to a total weight of the steel sheet.

Nitrogen (N)

Nitrogen (N) is an element that is concentrated in non-transformed austenite and serves to stabilize residual austenite. Nitrogen enhances tensile strength and strength-ductility balance of the steel sheet. Also, in the steel sheet of this invention, nitrogen (N) forms AlN, thereby causing grain refinement.

In the steel sheet of this invention, the content of nitrogen may be in the range of 0.003~0.008 wt % with respect to a total weight of the steel sheet.

If the content of nitrogen is less than 0.003 wt %, the effects of nitrogen are insignificant. Further, if the content of nitrogen exceeds 0.008 wt %, however, nitrogen becomes oversaturated during cooling after hot-dip galvanizing or during cooling of an alloying process, thereby deteriorating uniform elongation. Thus, the content of N may be in the range of 0.003~0.008 wt %.

Aluminum (Al)

Aluminum (Al) is used as a deoxidizing agent. Aluminum stabilizes ferrite grains to enhance elongation and increases the amount of carbon (C) concentrated in austenite to stabilize residual austenite. Further, aluminum (Al) prevents a reduction of elongation by suppressing the formation of the Mn band in a hot-rolled steel sheet.

In the steel sheet of this invention, the content of aluminum may be in the range of 0.05~0.4 wt % with respect to a total weight of the steel sheet.

If the content of aluminum (Al) is less than 0.05 wt %, the aforementioned effects of aluminum cannot be expected. Further, if the content of aluminum exceeds 0.4 wt %, continuous casting properties are deteriorated and MN is formed in the slab, thereby causing hot cracking.

Molybdenum (Mo), Chromium (Cr)

As a result of extensive studies, the inventors of the present invention found that the steel sheet has increased strength without deterioration of wettability when the inequality $10 \leq 50 \cdot [Mo\ \%] + 100 \cdot [Cr\ \%] \leq 30$ is satisfied.

When molybdenum (Mo) and chromium (Cr) are added in amounts of $50 \cdot [Mo\ \%] + 100[Cr\ \%] < 10$, strength of the steel sheet is insignificantly increased, and when molybdenum (Mo) and chromium (Cr) are added in the amounts of $50 \cdot [Mo\ \%] + 100[Cr\ \%] > 30$, the steel sheet suffers rapid deterioration of wettability. Thus, in this invention, molybdenum (Mo) and chromium (Cr) are added in the range of $0 \leq 50 \cdot [Mo\ \%] + 100[Cr\ \%] \leq 30$.

One or both of molybdenum (Mo) and chromium (Cr) may be added to the steel sheet in the range of $0 \leq 50 \cdot [Mo\ \%] + 100[Cr\ \%] \leq 30$. Next, each of molybdenum (Mo) and chromium (Cr) will be described in more detail.

Molybdenum (Mo)

Molybdenum (Mo) improves quenching properties and enhances strength of the steel sheet by securing a phase fraction of martensite. In order to complement the quenching properties relating to management of Mn, Mo may be added in an amount of 0.1 wt % or more. However, since the content of Mo exceeding 0.2 wt % can cause an increase of the yield ratio resulting from grain refinement, the Mo content may be in the range of 0.1~0.2 wt % with respect to a total weight of the steel sheet.

Chromium (Cr)

Like molybdenum (Mo), chromium (Cr) also improves quenching properties and enhances strength of the steel sheet by securing a phase fraction of martensite. Further, chromium (Cr) stabilizes ferrite grains to enhance elongation and increases the amount of carbon concentrated in austenite to stabilize residual austenite.

Chromium (Cr) may be added in the range of 0.1~0.2 wt % with respect to a total weight of the steel sheet. If Cr content is less than 0.1 wt %, the effects of chromium are insignificant, and if Cr content exceeds 0.2 wt %, wettability is deteriorated.

Titanium (Ti), Vanadium (V), Boron (B)

In this invention, the high strength steel sheet may further comprise at least one of titanium (Ti), vanadium (V) and boron (B) to enhance mechanical properties.

Titanium (Ti)

Titanium (Ti) is a strong carbon nitride formation element. Titanium (Ti) couples with nitrogen (N) in a ratio of 3.4:1 in the steel sheet to reduce the amount of dissolved nitrogen. The reduction in amount of dissolved nitrogen prevents the formation of BN and AlN, thereby preventing an increase in yield ratio caused by grain refinement.

Although the added amount of titanium (Ti) in the steel sheet depends on the amount of dissolved nitrogen in the steel, the content of titanium may be in the range of 0.005~0.02 wt % with respect to a total weight of the steel sheet. If Ti content is less than 0.005 wt %, the effects of titanium are insignificant, and if Ti content exceeds 0.02 wt %, titanium couples with carbon in the steel sheet, causing an excessive increase of the yield ratio.

Vanadium (V)

Along with boron (B) and molybdenum (Mo), vanadium (V) serves as a strong quenching property improving element that is effective in the formation of martensite in the steel. Further, vanadium (V) couples with carbon in ferrite to form in-grain carbides to increase strength, and reduces the amount of dissolved carbon, thereby lowering the yield ratio.

In this invention, the content of vanadium (V) may be in the range of 0.005~0.05 wt % with respect to a total weight of the steel sheet. If the content of vanadium is less than 0.005 wt %, the effects of vanadium (V) are insignificant, and if the content of vanadium exceeds 0.05 wt %, there is a problem that the yield ratio increases.

Boron (B)

Boron (B) serves as a strong quenching property improving element and can provide significant effect in the formation of martensite when the content of boron is 0.0005 wt % or more.

If the content of boron (B) exceeds 0.0015 wt % with respect to the total weight of the steel sheet, boron is segregated in grain boundaries, deteriorating wettability. Accordingly, in this invention, the content of boron may be in the range of 0.0005~0.0015 wt %.

According to the invention, a final microstructure of the high strength steel sheet is a multi-phase structure that has, in an area ratio of cross-sectional structure, 70% or more ferrite main phase and comprises martensite phase. The microstructure is determined by alloy compositions and heat treatment conditions.

Figure 3:
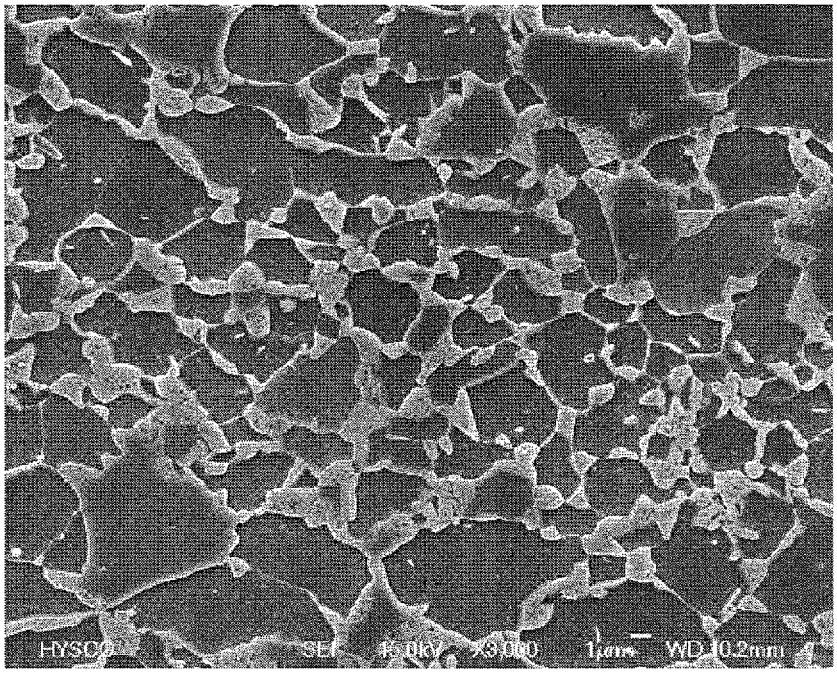
FIG. 3 is a picture of a cross-sectional microstructure of a high strength steel sheet in accordance with the present invention

Martensite has a circular shape and is finely dispersed in the grain boundary. The martensite structure is effective in lowering brittleness while enhancing elongation. The shape of martensite can be confirmed from the photomicrograph of an internal cross-section of a steel sheet as shown in FIG. 3. Martensite has a grain size of about 3~10 μm.

In this invention, the steel sheet may have an area ratio of cross-sectional structure of martensite in the range of 10~20%, that is, a phase fraction of martensite in the range of 10~20 vol. % with respect to a total volume of the steel sheet. If the phase fraction of martensite is less than 10 vol. %, it is difficult to obtain desired strength, and if the phase fraction of martensite exceeds 20 vol. %, yield strength increases, thereby deteriorating ductility and deep drawing properties.

Hardness of the microstructure is also determined by the alloy compositions and heat treatment conditions. In this invention, the ferrite phase has a Vickers hardness Hv of 120~250 and the martensite phase has a Vickers hardness Hv of 321~555.

If the main phase, that is, ferrite phase, has a Vickers hardness Hv less than 120, the amount of mobile dislocations generated in the ferrite phase is too low to obtain a significant increase of yield strength by paint baking. This leads to poor bake hardenability, which has a negative influence on dent resistance and shape fixability. Further, if the ferrite phase has a Vickers hardness Hv exceeding 250, the steel sheet has excessively increased tensile strength and suffers deterioration in ductility and deep drawing properties.

On the other hand, if the martensite phase has a Vickers hardness Hv less than 321, it is difficult to obtain desired strength, and if the martensite phase has a Vickers hardness exceeding 555, the yield strength is increased, and shape fixability and interior deformation can be deteriorated. Thus, the martensite phase may have a Vickers hardness Hv of 321~555.

In this invention, the high strength steel sheet with good wettability has mechanical properties including a tensile strength of 590 MPa or more, a strength-ductility balance of 16,520 MPa·% or more, and a yield ratio less than 60%.

Such mechanical properties could be achieved by optionally adding chromium (Cr), vanadium (V), and boron (B) in addition to molybdenum (Mo), which is an element for improving quenching properties, in order to facilitate the formation of martensite.

Further, in order to secure wettability, the content of Si was restricted to 0.105 wt % or less, and the problem of reduction in hardness and carbon concentration degree in austenite possibly caused by the restriction of Si content was complemented by addition of aluminum (Al), chromium (Cr), phosphorous (P), and the like.

Further, in order to maintain the effects by addition of Mn, the added amount of sulfur (S) was restricted below 0.003 wt %, whereby it was possible to prevent deterioration in material quality due to the formation of MnS inclusions after heat treatment.

Further, TiN and TiS were formed at high temperature regions by addition of Ti to maximize influences of dissolved boron (B), manganese (Mn) and aluminum (Al), thereby facilitating the formation of martensite. Titanium (Ti) could prevent deterioration of elongation resulting from grain refinement by suppressing the formation of BN.

Accordingly, the high strength steel sheet with good wettability according to this invention can be widely applied not only to pipe formation by pressing or roll forming, which has a relatively small processing amount, but also to drawing, which requires relatively strict processing conditions.

Method of Manufacturing High Strength Steel Sheet

Figure 2:
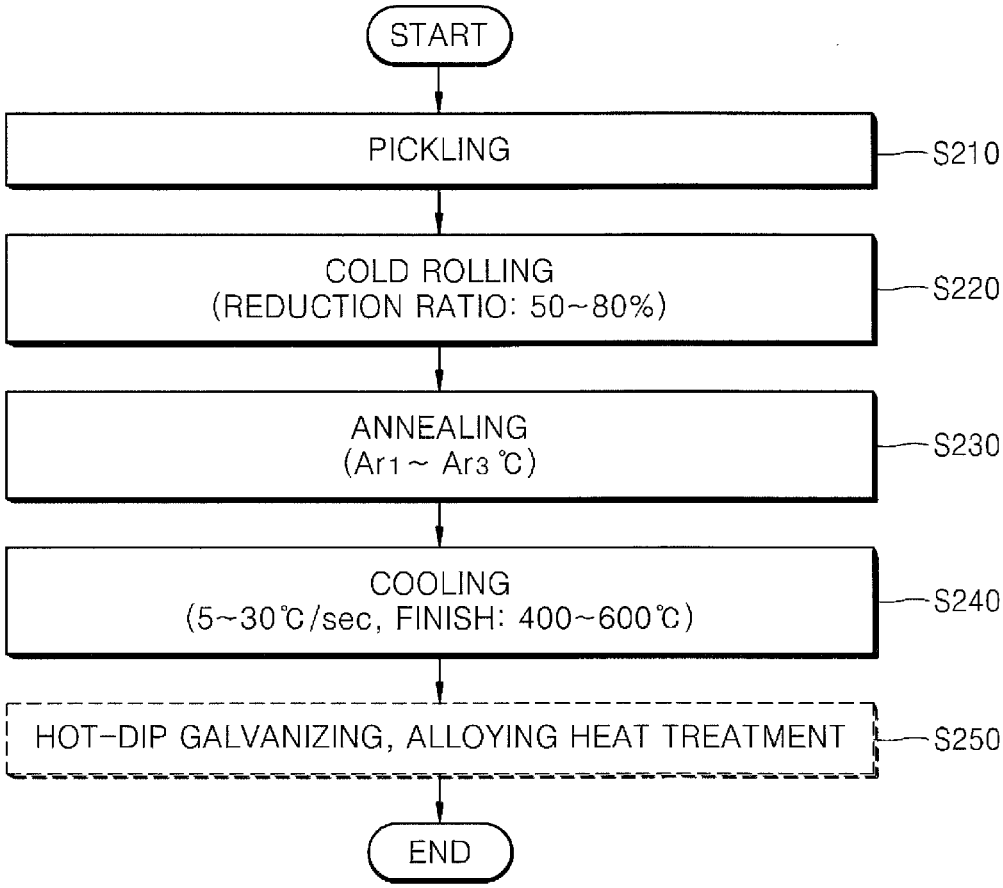
FIG. 2 is a flowchart of the method of manufacturing a high strength steel sheet in accordance with the embodiment of the present invention, showing a process of manufacturing a cold-rolled steel sheet from the hot-rolled steel sheet.

FIGS. 1 and 2 are flowcharts of a method of manufacturing a high strength steel sheet in accordance with one embodiment of the invention. Specifically, FIG. 1 is a flowchart showing a process of manufacturing a hot-rolled steel sheet from a steel slab, and FIG. 2 is a flowchart showing a process of manufacturing a cold-rolled steel sheet from the hot-rolled steel sheet.

Referring to FIG. 1, a process of manufacturing a hot-rolled steel sheet includes steel slab reheating (S110), finish hot rolling (S120), and coiling (S130).

In the step of reheating a steel slab (S110), the steel slab is reheated. Here, the steel slab comprises, in % by weight, C: 0.03~0.1%, Si: 0.005~0.105%, Mn: 1.0~3.0%, P: 0.005~0.04%, S: 0.003% or less, N: 0.003~0.008%, Al: 0.05~0.4%, Mo or Cr satisfying the inequality $10 \leq 50 \cdot [Mo\ \%] + 100[Cr\ \%] \leq 30$, at least one of Ti: 0.005~0.02%, V: 0.005~0.05% and B: 0.0005~0.0015%, and the balance of Fe and unavoidable impurities.

The slab may be manufactured through continuous casting of molten steel obtained through a steel making process.

The reheating temperature of the steel slab may be in the range of 1150~1250° C. If the reheating temperature is less than 1150° C., hot rolling is not satisfactorily carried out, and if the reheating temperature exceeds 1250° C., it is difficult to guarantee strength of the steel sheet.

Then, in the step of finish hot rolling (S120), the finish hot rolling is performed at $Ar_3$~$Ar_3$+70° C. Then, in the step of coiling (S130), the steel sheet subjected to the finish hot rolling is coiled at 550~650° C. into a hot-rolled steel sheet in coils, thereby finishing the manufacture of the hot-rolled steel plate.

Next, referring to FIG. 2, the process of manufacturing a cold-rolled steel sheet includes pickling (S210), cold rolling (S220), annealing (S230), and cooling (S240).

In the step of pickling (S210), the surface of the hot rolled steel sheet is subjected to pickling with week acid and the like.

Then, in the step of cold rolling (S220), the pickled steel sheet is subjected to cold rolling at a reduction ratio of 50~80% using cold work rolls. Then, the cold-rolled steel sheet is subjected to annealing at $Ar_1$~$Ar_3$, followed by cooling to 400~600° C. at a cooling rate of 5~30° C./sec.

After cooling the steel sheet to 400~600° C., hot-dip galvanizing or alloying heat treatment may be further carried out with respect to the cold-rolled steel sheet, as needed (S250).

As such, the high strength steel sheet has a multi-phase structure of ferrite and martensite and exhibits good wettability through adjustment of the C and Si contents.

Further, the high strength steel sheet with good wettability optionally contains a quenching property-enhancing element and titanium (Ti) to control precipitation of BN, AlN, and the like. Therefore, during annealing after cold rolling, 10~20% martensite remains in the steel sheet, so that the steel sheet has a tensile strength of 590 MPa or more, a strength-ductility balance of 16,520 MPa·% or more, and a yield ratio less than 60%. This steel sheet permits easy machining of component shapes therefrom and a thickness reduction with a strength increase, thereby reducing the total weight of a vehicle and improving fuel efficiency.

Moreover, the high strength steel sheet with good wettability has the dual-phase structure, thereby eliminating a need for narrow width management with respect to carbon (C) and nitrogen (N) components, and a low yield ratio of the high strength steel sheet provides good shape fixability.

EXAMPLES

Next, the present invention will be described with reference to some examples. However, these examples are given by way illustration only and should not be interpreted as restricting the scope of the invention in any sense.

Details not described herein can be technically derived by those skilled in the art, and thus, descriptions thereof will be omitted herein.

1. Manufacture of Steel Sheet

Each of slabs having compositions as shown in Table 1 was subjected to finish hot rolling, coiling, pickling, cold rolling, annealing, cooling, and hot-dip galvanizing according to the conditions listed in Table 2, thereby providing hot-dip galvanized steel sheets of Examples 1 to 14 and Comparative Examples 15 to 22.

TABLE 1

| Kind | No. | C | Si | Mn | P | S | N | Al | Mo | Cr | Ti | V | B |
|---|---|---|---|---|---|---|---|---|---|---|---|---|---|
| Example | A | 0.062 | 0.035 | 1.98 | 0.016 | 0.003 | 0.003 | 0.051 | 0.221 | | | | |
| | B | 0.063 | 0.037 | 1.95 | 0.012 | 0.003 | 0.004 | 0.055 | 0.210 | 0.158 | | | |
| | C | 0.061 | 0.036 | 2.03 | 0.017 | 0.003 | 0.004 | 0.054 | 0.055 | 0.095 | | | 0.001 |
| | D | 0.059 | 0.037 | 1.99 | 0.015 | 0.002 | 0.003 | 0.301 | 0.198 | 0.096 | | | |
| | E | 0.085 | 0.095 | 1.98 | 0.023 | 0.003 | 0.006 | 0.215 | 0.105 | 0.121 | | 0.015 | |
| | F | 0.083 | 0.101 | 1.96 | 0.025 | 0.003 | 0.007 | 0.395 | 0.052 | 0.096 | 0.018 | | |
| | G | 0.089 | 0.091 | 1.51 | 0.023 | 0.003 | 0.007 | 0.241 | 0.101 | 0.158 | 0.017 | | |
| | H | 0.069 | 0.035 | 2.02 | 0.019 | 0.003 | 0.006 | 0.056 | 0.107 | 0.151 | | | |
| | I | 0.087 | 0.095 | 1.56 | 0.020 | 0.003 | 0.006 | 0.237 | 0.108 | 0.161 | 0.015 | | |
| C-Example | J | 0.068 | 0.305 | 1.97 | 0.015 | 0.002 | 0.004 | 0.115 | | | 0.016 | | |
| | K | 0.083 | 0.353 | 2.07 | 0.012 | 0.003 | 0.007 | 0.154 | 0.207 | | | | |
| | L | 0.082 | 0.099 | 1.99 | 0.015 | 0.003 | 0.004 | 0.152 | | | | 0.011 | |
| | M | 0.091 | 0.151 | 2.03 | 0.017 | 0.004 | 0.005 | 0.205 | 0.059 | | | | |
| | N | 0.101 | 0.094 | 2.04 | 0.015 | 0.003 | 0.004 | 0.211 | | 0.092 | | | |

Unit: % by weight, C-Example: comparative example

TABLE 2

| | | | Hot rolling condition | | | Continuous annealing condition | | | |
|---|---|---|---|---|---|---|---|---|---|
| | | | | Finish | | | Cooling | | |
| Kind | Test No. | Steel No. | Slab reheating (° C.) | hot rolling (° C.) | Coiling (° C.) | Anneal (° C.) | Rate (° C./sec) | Finish Temp. (° C.) | Hot-dip Alloying (° C.) |
| Example | 1 | A | 1200 | 840 | 650 | 790 | 21 | 480 | 510 |
| | 2 | B | 1200 | 840 | 650 | 790 | 21 | 480 | 510 |
| | 3 | C | 1200 | 850 | 650 | 850 | 21 | 480 | 510 |
| | 4 | | 1200 | 840 | 650 | 830 | 30 | 480 | 510 |
| | 5 | | 1200 | 840 | 650 | 790 | 21 | 480 | 510 |
| | 6 | | 1200 | 840 | 560 | 800 | 21 | 450 | 510 |
| | 7 | D | 1200 | 850 | 650 | 790 | 21 | 480 | 510 |
| | 8 | E | 1200 | 850 | 650 | 790 | 21 | 480 | 510 |
| | 9 | F | 1200 | 850 | 650 | 790 | 21 | 450 | 510 |
| | 10 | G | 1200 | 850 | 650 | 790 | 21 | 480 | 510 |
| | 11 | H | 1200 | 840 | 650 | 790 | 21 | 480 | 510 |
| | 12 | I | 1200 | 840 | 650 | 800 | 21 | 480 | 510 |
| | 13 | | 1200 | 840 | 650 | 790 | 21 | 450 | 510 |
| | 14 | | 1200 | 850 | 650 | 790 | 21 | 400 | 510 |
| Comparative Example | 15 | J | 1200 | 840 | 650 | 790 | 21 | 480 | 510 |
| | 16 | K | 1200 | 850 | 650 | 850 | 21 | 550 | 510 |
| | 17 | | 1200 | 840 | 650 | 800 | 21 | 480 | 510 |
| | 18 | | 1200 | 840 | 650 | 790 | 21 | 450 | 510 |
| | 19 | | 1200 | 850 | 560 | 790 | 30 | 400 | 510 |
| | 20 | L | 1200 | 850 | 650 | 790 | 21 | 480 | 510 |
| | 21 | M | 1200 | 840 | 650 | 790 | 21 | 480 | 510 |
| | 22 | N | 1200 | 840 | 650 | 790 | 21 | 480 | 510 |

2. Mechanical Properties and Wettability

Table 3 shows tensile strength (TS: MPa), strength-ductility balance (TS×EL: MPa %), yield ratio (%), Vickers hardness (Hv), and wettability of the steel sheets of Examples 1 to 14 and Comparative Examples 15 to 22.

TABLE 3

| Kind | Test No. | Steel No. | TS (MPa) | TS × EL (MPa %) | YR | CS-area ratio (%) F | CS-area ratio (%) M | Hv F | Hv M | Wettability |
|---|---|---|---|---|---|---|---|---|---|---|
| Example | 1 | A | 618 | 16593 | 49 | 85 | 13 | 152 | 487 | ◎ |
| | 2 | B | 623 | 17233 | 50 | 86 | 13 | 163 | 495 | ◎ |
| | 3 | C | 593 | 16690 | 55 | 88 | 11 | 197 | 451 | ◎ |
| | 4 | | 631 | 17137 | 54 | 87 | 13 | 162 | 509 | ◎ |
| | 5 | | 625 | 18225 | 52 | 85 | 14 | 179 | 496 | ◎ |
| | 6 | | 611 | 18322 | 55 | 84 | 12 | 171 | 477 | ◎ |
| | 7 | D | 658 | 19755 | 54 | 84 | 15 | 193 | 512 | ◎ |
| | 8 | E | 642 | 18625 | 55 | 84 | 15 | 189 | 526 | ○ |
| | 9 | F | 674 | 18973 | 51 | 84 | 15 | 186 | 538 | ○ |
| | 10 | G | 689 | 20051 | 52 | 83 | 17 | 201 | 554 | ○ |
| | 11 | H | 652 | 18910 | 52 | 82 | 17 | 195 | 535 | ◎ |
| | 12 | I | 697 | 20915 | 52 | 83 | 17 | 192 | 551 | ○ |
| | 13 | | 674 | 19546 | 54 | 83 | 15 | 185 | 539 | ○ |
| | 14 | | 632 | 18328 | 57 | 80 | 14 | 179 | 512 | ○ |
| Comparative Example | 15 | J | 658 | 15134 | 57 | 85 | 15 | 173 | 553 | Δ |
| | 16 | K | 672 | 16128 | 51 | 84 | 16 | 176 | 556 | Δ |
| | 17 | | 667 | 16008 | 55 | 85 | 15 | 171 | 528 | Δ |
| | 18 | | 663 | 16243 | 57 | 84 | 15 | 165 | 517 | Δ |
| | 19 | | 629 | 15725 | 59 | 84 | 15 | 163 | 514 | Δ |
| | 20 | L | 497 | 14910 | 65 | 89 | 7 | 103 | 472 | ○ |
| | 21 | M | 513 | 16213 | 61 | 85 | 9 | 112 | 458 | ○ |
| | 22 | N | 525 | 16050 | 62 | 87 | 9 | 115 | 479 | ○ |

YR: Yield ratio, F: Ferrite, M: Martensite, CS-area ratio: cross-sectional structure area ratio, Hv: Vickers hardness Referring to FIG. 3, all of Examples 1 to 14 exhibit a tensile strength of 590 MPa or more, a strength-ductility balance (TS×El) of 16,520 MPa % or more, and a yield ratio less than 60%, thereby indicating that all of Examples 1 to 14 have desired mechanical properties. On the other hand, Comparative Examples 15 to 22 have a strength-ductility balance (TS×El) less than 16,520 MPa %, and Comparative Examples 20 to 22 have a tensile strength less than 590 MPa and a yield ratio exceeding 60%.

Further, the steel sheets of Examples 1 to 14 have area ratios of cross-sectional ferrite structure in the range of 80~88%, area ratios of cross-sectional martensite structure in the range of 11~17%, Vickers hardness of ferrite in the range of 152~201, and Vickers hardness of martensite in the range of 451~554, thereby satisfying desired conditions in terms of area ratio of cross-sectional structure and Vickers hardness.

Further, the steel sheets of Examples 1 to 14 exhibit very good wettability (◎) or good wettability (○), but the steel sheets of Comparative Examples 15 to 19 exhibit normal wettability (Δ). On the other hand, for Comparative examples 20 to 22 exhibiting good wettability (○), the mechanical properties such as tensile strength are insufficient, the area ratio of cross-sectional martensite structure is less than 10%, and Vickers hardness of ferrite is less than 120.

Although the present invention has been described with reference to some embodiments, it will be apparent to those skilled in the art that the embodiments are given by way of illustration only, and that that various modifications, changes, alterations, and equivalent embodiments can be made without departing from the spirit and scope of the invention. The scope of the invention should be limited only by the accompanying claims.

What is claimed is:

1. A steel sheet comprising, in % by weight,

C: 0.03-0.1%;

Si: 0.005-0.105%;

Mn: 1.0-3.0%;

P: 0.005-0.04%;

S: 0.003% or less;

N: 0.003-0.008%;

Al: 0.05-0.4%;

V: 0.005-0.05%;

additional components consisting of Mo and Cr, wherein concentrations of the additional components satisfies the inequality 10<50*[Mo %]+100*[Cr %]<30; and a balance of Fe and unavoidable impurities, wherein a microstructure of the steel sheet includes at least two phases comprising, in an area ratio of cross-sectional structure, 70% or more ferrite phase having a Vickers hardness Hv of 120-250 and 10% or more martensite phase having a Vickers hardness Hv of 321-555; and wherein the concentrations of the additional components which satisfies the inequality 10<50*[Mo %]+100[Cr %]<30, simultaneously increases the strength and obviates wettability deteriation of the steel sheet.

2. A method of making a steel sheet, the method comprising:

reheating a steel slab to 1150° C. to 1250° C., the steel slab comprising, in % by weight,

C: 0.03-0.1%;

Si: 0.005-0.105%;

Mn: 1.0-3.0%;

P: 0.005-0.04%;

S: 0.003% or less;

N: 0.003-0.008%;

Al: 0.05-0.4%;

V: 0.005-0.05%;

additional components consisting of Mo and Cr, wherein concentrations of the additional components satisfies the inequality 10<50*[Mo %]+100*[Cr %]<30; and a balance of Fe and unavoidable impurities, hot rolling the reheated steel slab at a finish rolling temperature of $Ar_3$—$Ar_3$+70° C. to form a hot-rolled steel sheet;

coiling the hot-rolled steel sheet a temperature ranging from 550° C.-650° C.;

pickling the hot-rolled steel sheet;

cold rolling the pickled steel sheet at a reduction ratio 50-80%;

annealing the cold-rolled steel sheet at a temperature of $Ar_1$—$Ar_3$; and cooling the annealed steel sheet to 400° C.-600° C. at a cooling rate of 5° C./sec-30° C./sec; and wherein the concentrations of the additional components which satisfies the inequality 10<50*[Mo %]+100*[Cr %]<30, simultaneously increases the strength and obviates wettability deteriation of the steel sheet.

3. The steel sheet according to claim 1, wherein molybdenum (Mo) is added in an amount of 0.1-0.2 wt % to the steel sheet.

4. The steel sheet according to claim 1, wherein chromium (Cr) is added in an amount of 0.1-0.2 wt % to the steel sheet.

5. The steel sheet according to claim 1, wherein the martensite phase has an area ratio of cross-sectional structure in the range of 10-20%.

6. The steel sheet according to claim 1, wherein the steel sheet has a tensile strength of 590 MPa or more, a strength-ductility balance of 16,520 MPa*%, and a yield ratio less than 60%.

7. The method according to claim 2, further comprising:

hot-dip galvanizing or performing alloying heat treatment for the cooled steel sheet.

8. The method according to claim 2, wherein a final microstructure of the steel sheet comprises, in an area ratio of cross-sectional structure, 70% or more ferrite phase and 10% or more martensite phase.

9. The method of claim 8, wherein the ferrite phase has a Vickers hardness of 120-250 and the martensite has a Vickers hardness of 321-555.

* * * * *